US007462332B2

(12) United States Patent
Hardesty et al.

(10) Patent No.: US 7,462,332 B2
(45) Date of Patent: Dec. 9, 2008

(54) APPARATUS AND METHOD FOR MANUFACTURING A CATALYTIC CONVERTER

(75) Inventors: Jeffrey B. Hardesty, Byron, MI (US); Stephen J. Myers, Owosso, MI (US); Paul E. Jankowski, Goodrich, MI (US); Gordon J. Rutland, Flint, MI (US); Michael R. Foster, Columbiaville, MI (US)

(73) Assignee: Delphi Technologies, Inc., Troy, MI (US)

( * ) Notice: Subject to any disclaimer, the term of this patent is extended or adjusted under 35 U.S.C. 154(b) by 674 days.

(21) Appl. No.: 10/465,356

(22) Filed: Jun. 18, 2003

(65) Prior Publication Data

US 2004/0258583 A1 Dec. 23, 2004

(51) Int. Cl.
*B01D 50/00* (2006.01)

(52) U.S. Cl. ..... 422/179; 422/177; 422/180

(58) Field of Classification Search ..... 422/168, 422/177–180, 221–222; 428/920; 285/49, 285/226, 300

See application file for complete search history.

(56) References Cited

U.S. PATENT DOCUMENTS 3,381,774 A * 5/1968 Stade et al. ..... 181/272
3,912,459 A * 10/1975 Kearsley ..... 422/179
3,972,687 A * 8/1976 Frietzsche ..... 422/180
3,990,859 A * 11/1976 Waite ..... 422/179
4,002,433 A * 1/1977 Oser ..... 422/176
4,145,394 A * 3/1979 Abthoff et al. ..... 422/179
4,207,661 A * 6/1980 Mase et al. ..... 29/890
5,653,478 A * 8/1997 McGurk et al. ..... 285/227
6,001,314 A 12/1999 Buck et al. ..... 422/177
6,010,668 A * 1/2000 Lawrence et al. ..... 422/176
6,159,430 A * 12/2000 Foster ..... 422/179
6,338,827 B1 1/2002 Nelson
6,354,903 B1 3/2002 Nelson
6,361,821 B1 3/2002 Anderson et al.
6,391,822 B1 5/2002 Dou et al.
6,438,839 B1 8/2002 Hardesty et al.
6,455,463 B1 9/2002 Labarge et al.
6,464,945 B1 10/2002 Hemingway
6,464,947 B2 10/2002 Balland
6,497,847 B2 12/2002 Foster et al.
6,532,659 B1 3/2003 DeSousa et al.
6,552,294 B1 4/2003 Ananthanarayanan et al. ..... 219/107
6,591,497 B2 7/2003 Foster et al.
6,605,259 B1 8/2003 Henry
6,623,704 B1 9/2003 Roth
6,624,113 B2 9/2003 Labarge et al.
6,643,928 B2 11/2003 Hardesty et al.
6,669,912 B1 * 12/2003 Udell ..... 422/179
2002/0172626 A1 11/2002 Lesher et al. ..... 422/179

FOREIGN PATENT DOCUMENTS

EP 1214976 A1 * 6/2002

* cited by examiner

*Primary Examiner*—Tom Duong
(74) *Attorney, Agent, or Firm*—Paul L. Marshall

(57) ABSTRACT

Disclosed herein is a method of making a catalytic converter; forming a shell having a welding deformation detail; inserting and housing a catalyst substrate inside the shell, wherein a mat support material is disposed between the shell and the catalyst substrate; welding an end cone having a flange to the shell by applying a deformation force to the flange causing deformation of welding deformation detail.

10 Claims, 6 Drawing Sheets

APPARATUS AND METHOD FOR MANUFACTURING A CATALYTIC CONVERTER

BACKGROUND

Catalytic converters have been employed to catalyze exhaust fluids in vehicles for more than twenty years and have been manufactured in a number of ways. Catalytic converters play a critical role in ensuring that fuel rich fluids are reduced down to acceptable levels, and are a comparatively expensive article within an exhaust system. The materials are expensive, and manufacture is labor intensive. Furthermore, design packages that increase durability and improve overall system performance for reductions in emissions are at a premium. Accordingly, methods of manufacture have been put forth in attempts to reduce manufacturing costs, while at the same time, increasing durability and stabilizing system performance.

One method of manufacturing catalytic converters is to provide a pre-made canister and stuff it with the catalyst substrate and the insulation/support pad. In this method, the catalyst substrate is wrapped with an intumescent or non-intumescent mat of a selected thickness and weight (various weights are employed for various applications and desired properties). Generally, the wrapped substrate material will create an assembly having outer dimensions that measure about 8 mm larger than the inside dimensions of the converter shell or canister. The assembly as described is then forced through a reduction cone and into the converter shell. Up to about 20,000 lbs of force may be used to accomplish the insertion of the assembly into the can. More particularly, within this range a force up to 7,000 lbs may be used. The method is costly.

A catalytic converter may be produced by a method referred to as "the tourniquet method." The tourniquet method dispenses with the reducing cone and thus avoids the high insertion pressures on the substrate and mat materials. The method places the substrate and mat assembly into a canister open on one longitudinal edge. The canister is closed around the assembly by straps and compressed to the desired size. The open ends of the canister will, in this position, be overlapping and then are welded together. This method is also expensive and labor intensive. Further, due to this overlap, engineering design consideration must be given to the space alteration inside the canister due to the overlapped edge. The overlapped edge causes a mat density change in the local area of the overlap. This is a further cost addition.

Further, both of the above described catalyst and shell assemblies may have transitional areas to accommodate any difference in diameter between the catalyst shell diameter and the diameter of inlet and outlet pipes. These transitions, e.g., endcones, may be affixed to the shell by Metal Inert Gas (MIG) welding, which may result in a significant amount of cycle time and heat addition to the parts. An alternative to MIG welding is spinforming of the ends of a shell that extends beyond the ends of the catalyst. This process is also high in cycle time and also results in parts having a large area of heated surface. Accordingly, there remains a need in the art for a catalytic converter that is easily and inexpensively manufactured, that increases durability, and does not restrict design choice.

SUMMARY

Disclosed herein is a catalytic converter including a shell having a welding deformation detail; a catalyst substrate inserted within the shell; a mat support material disposed between the catalyst substrate and the shell; an end cone having a flange; and wherein the flange is deformation welded to the shell at the welding deformation detail.

Further disclosed herein is a method of making a catalytic converter including forming a shell having a welding deformation detail; inserting and housing a catalyst substrate inside the shell, wherein a mat support material is disposed between the shell and the catalyst substrate; welding an end cone having a flange to the shell by applying a deformation force to the flange causing deformation of welding deformation detail.

The above-described and other features will be appreciated and understood by those skilled in the art from the following detailed description, drawings, and appended claims.

DRAWINGS

Referring now to the figures, which are exemplary embodiments, and wherein the like elements are numbered alike:

DETAILED DESCRIPTION

Figure 1:
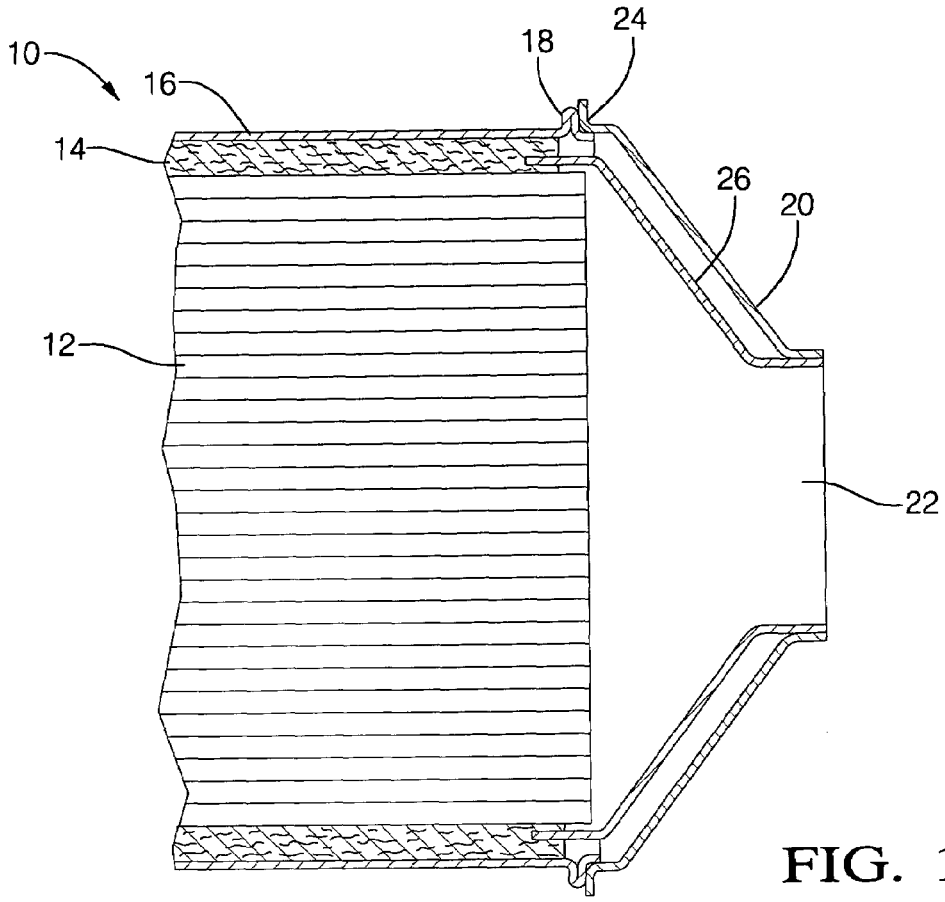
FIG. 1 is a partial cross-sectional view of a catalytic converter embodiment comprising an annular deformation resistance weld at the interface between converter shell and end cone.

A method of welding end-cones to a converter assembly is described below. Although the method is described in relation to welding end-cones to a converter assembly, this method may also be used in other welding applications, e.g., tube to tube, converter to tube, and the like.

Annular Deformation Resistance Welding (ADRW), as used herein, refers generally to a welding method, wherein a joint is formed through the deformation and displacement of material at the weld interface. Annular Deformation Resistance Welding is also described in U.S. Pat. No. 6,552,294 to Ananthanarayanan et al., which is herein incorporated by reference. Although ADRW is similar to "Resistance Welding," it is a distinct welding method as will be discussed in greater detail. Resistance welding, as used herein, refers generally to a method used to join metallic parts with electric current. There are several forms of resistance welding, including, for example, spot welding, seam selding, projection welding, butt welding, and the like. In all forms of resistance welding, the parts are locally heated until a molten pool forms. The parts are then allowed to cool, and the pool solidifies to form a weld bond. Generally, during resistance welding, an operator of resistance welding equipment has control over, for example, current setting, electrode force, and weld time.

In resistance welding, heat is created by electrode(s) passing an electric current through the work pieces. The heat generated may depend on electrical resistance and thermal conductivity of the metal, and the time that the current is applied. The heat generated may be expressed by the following equation:

$$E=I^2\cdot R\cdot t$$

where E is the heat energy, I is the current, R is the electrical resistance and t is the time that the current is applied. Copper may be used for electrodes, because it has a low resistance and high thermal conductivity compared to most metals. This promotes heat generation in the work pieces instead of the electrodes. The electrodes may be cooled with water, removing excess heat, to prevent the electrodes from overheating.

Furthermore, in resistance welding, the electrodes are held under a controlled force during welding. The resistance across the interfaces between the work pieces and the electrodes may be affected by the amount of the force applied. The force may be adjusted to immediately create heat at the interface between the work pieces. Moreover, if the force is too low expulsion, weld splash, and/or the like can occur. The heat used to produce the molten pool may depend on, for example, the thermal conductivity and melting point of the metal being welded. A material with a relatively high thermal conductivity will quickly conduct heat away from the weld pool, thus increasing the total heat used to melt the pool compared to a material with a relatively low melting point.

In ADRW, at least one of the work pieces comprises a deformation detail, for example, a rib portion, wherein welding occurs at the deformation detail. As will be discussed in greater detail, the deformation detail facilitates deformation under a deformation force. Like simple resistance welding, an electrode is applied to the work piece. For example, a current of about 5,000 amperes to about 20,000 amperes is applied for less than 1 second. More particularly, a current of about 15,000 amperes to 20,000 amperes is used. Further, the electrode(s) apply a force of about 300 to 800 pounds to the work piece. Unlike simple resistance welding, however, in ADRW; the force applied by the electrode causes deformation of the deformation detail. For example, if the deformation detail is a rib portion, the force applied by the electrode causes the rib to compress, i.e., deform. Furthermore, the welding surfaces are deformed under the heat generated by the current across the welding surfaces and the force of the electrodes. A weld bond is formed while the materials are in this plastic-like state, which allows impurities in the metal to be displaced away from the weld bond as the welding surfaces are placed in intimate contact with each other under the electrode force. In other words, impurities are pushed radially away from the weld area, i.e., the material is ejected away from the area that forms the weld bond, allowing for a metal-to-metal weld bond relatively free of contaminates. In the ADRW method, the deformation has an action linear distance about equal to the desired weld bond. For example, the weld bond is about equal to the thickness of one material thickness in order to be of equal load bearing capacity as the parent material.

Further, the deformation detail is not limited to embodiments depicting a rib portion; rather the deformation detail may be a detail (i.e., feature) that facilitates deformation as described above. Moreover, the ADRW method may be used to create leak-tight joints with uniform circumferential weld strength. The term "leak-tight", as used herein, refers to a joint that generally prohibits the passage of fluid therethrough.

Additionally, the heat-affected zone of the weld in the ADRW method is much smaller, resulting in less strength reduction of the parent materials when compared to, for example, Gas Metal Arc Welding (GMAW), and the like. GMAW may also be referred to as Metal Inert Gas (MIG) welding. In MIG welding the "inert gas" refers to a shielding gas, which is generally supplied from a cylinder or other gas source and then piped to the welding gun. Further, a metal wire is used to start the arc, and then is fed into the puddle of molten metal to continuously replenish the metal in the puddle that is used to join the materials.

The ADRW method allows the weld to be monitored to indicate quality of the finished product, which is advantageous in that it may reduce weld repair, and may have potential for reducing capital expenditure for inspection equipment (e.g., elimination of leak tester). Moreover, this method may reduce cycle time to less than about 5 seconds and even a cycle time of about 1 second (s) in some embodiments. Thus, an increased capacity of a production cell may be realized, while using substantially the same capital.

Several combinations of catalytic converters are discussed hereunder with reference to individual drawing figures. One of skill in the art will easily recognize that many of the components of each of the embodiments are similar or identical to the others. Each of these elements is introduced in the discussion of FIG. 1, but is not repeated for each embodiment. Distinct structure is discussed relative to each figure/embodiments.

Referring now to FIG. 1, an exemplary catalytic converter embodiment generally designated 10 is illustrated. Catalytic converter 10 comprises a catalyst substrate 12 inserted and housed within a shell 16 with a mat support material 14 disposed therebetween. A subassembly is formed when mat support material 14 is wrapped around catalyst substrate 12. Shell 16 is disposed around mat support material 14 and is sized and shaped depending on the size and shape of the subassembly. Shell 16 comprises a shell rib portion 18 having a surface area sufficient to provide a welding interface with an end cone 20.

End cone 20 comprises an opening 22, a flange 24, and an inner cone 26. As will be discussed in greater detail, end cone 20 is joined to shell 16 at ribbed portion 18 using the ADRW method. End cone 20 is blanked, i.e., the sheet metal forming process by which the part is removed from the strip of parent metal. This blanking process leaves flange 24, which then fits over shell 16, wherein ribbed portion 18 of shell 16 abuts flange 24 of end cone 20. Since end cone 20 is cut from the parent metal by blanking instead of blanking and pinch trimming a comparatively more simple end cone 20 form may be used. The term "pinch trimming" as used herein refers an additional process where a flange (e.g., 24), which is formed by a previous blanking process is then pushed through an additional die detail that wipes the short flange, left from blanking, along the centerline leaving a longer skirt. This type of endcone may be used, for example, on stuffed shells. Flange 24 comprises a mating surface sufficient for an electrode (not shown). During the ADRW method, an electrode applies a force to flange 24, wherein deformation occurs in the weld area under the force and heat generated by the current flow across the interface from rib portion 18 to flange 24. Moreover, the force applied by the electrode is sufficient to cause deformation between rib portion 18 and flange 24. The deformation is accomplished in FIG. 1 due to the mismatch in flatness of the two surfaces of rib portion 18 and flange 24 respectively. In other words, the two surfaces are not flat relative to one-another.

Figure 2:
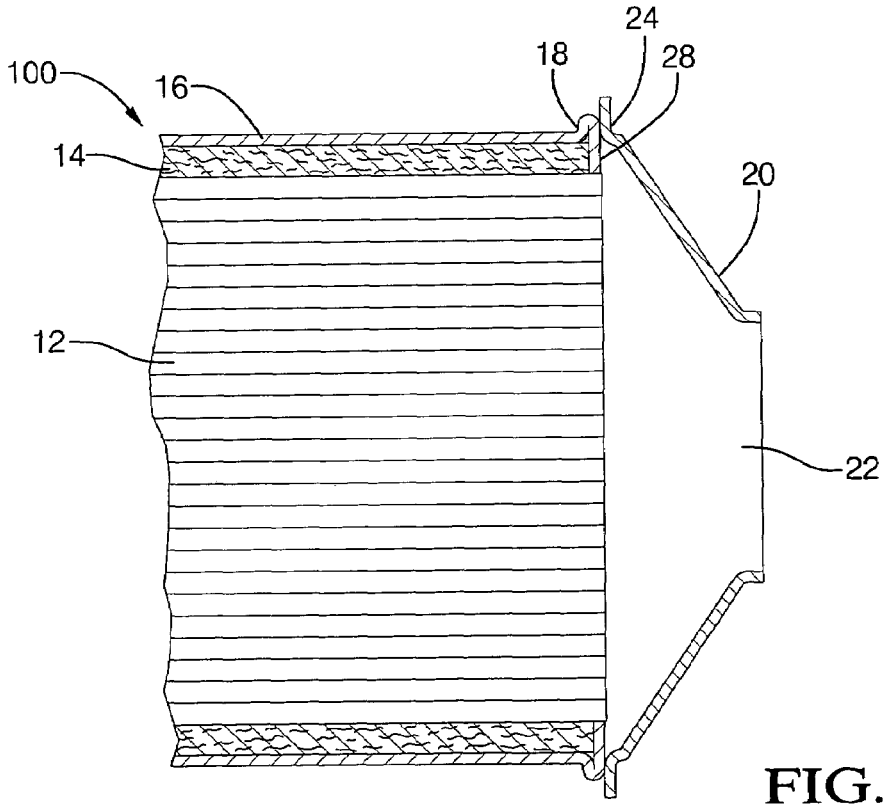
FIG. 2 is a partial cross-sectional view of an embodiment comprising a mat support protection surface formed by a shell portion.

As mentioned above, the distinct elements of each embodiment are discussed in each figure, for example, FIG. 2 illustrates a catalytic converter embodiment generally designated 100 comprising a mat support protection surface 28. Mat protection surface 28 may be formed in the same operation that creates shell rib portion 18. In other words, an end portion of shell 16 is used to form mat protection surface 28. Mat protection surface 28 may be used to shield mat support material 14 from high temperature exhaust fluid, which may cause mat support material 14 to overheat under certain high temperature conditions. Further, it may be used to reduce the temperature of the outer surface of catalytic converter 100 and/or to protect mat support material 14 from exhaust fluid erosion.

Figure 3:
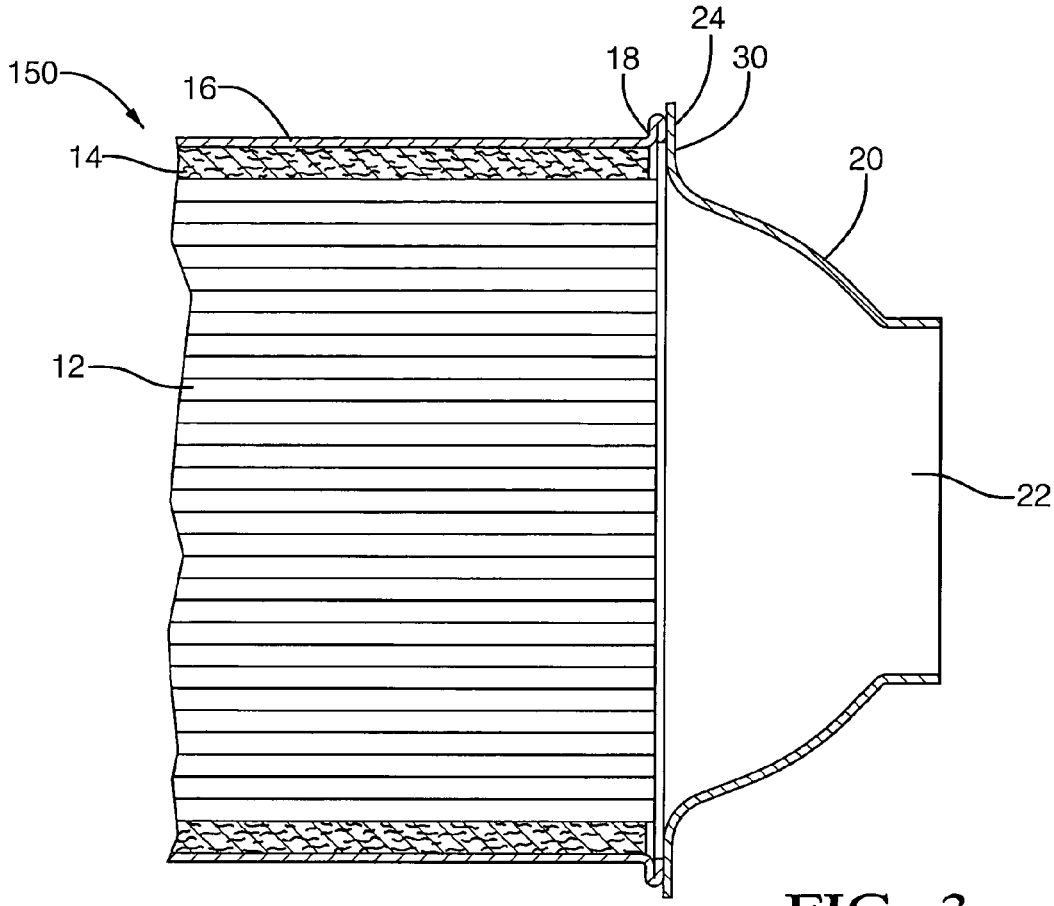
FIG. 3 is a partial cross-sectional view of an embodiment comprising a mat support protection surface formed by an extended flange portion of an end cone.

FIG. 3 illustrates a catalytic converter embodiment generally designated 150 comprising a mat protection surface 30. Mat protection surface 30 is formed when flange 24 is welded to shell 16. In this embodiment, flange 24 comprises an extended length parallel to the face of catalyst substrate12, forming mat protection surface 30. Similar to mat protection surface 28 depicted in FIG. 2, mat protection 30 may be used to shield shell 16 from high temperature exhaust fluid, to reduce the temperature of the outer surface of catalytic converter 150; and/or to protect mat support material 14 from exhaust fluid erosion.

Figure 4:
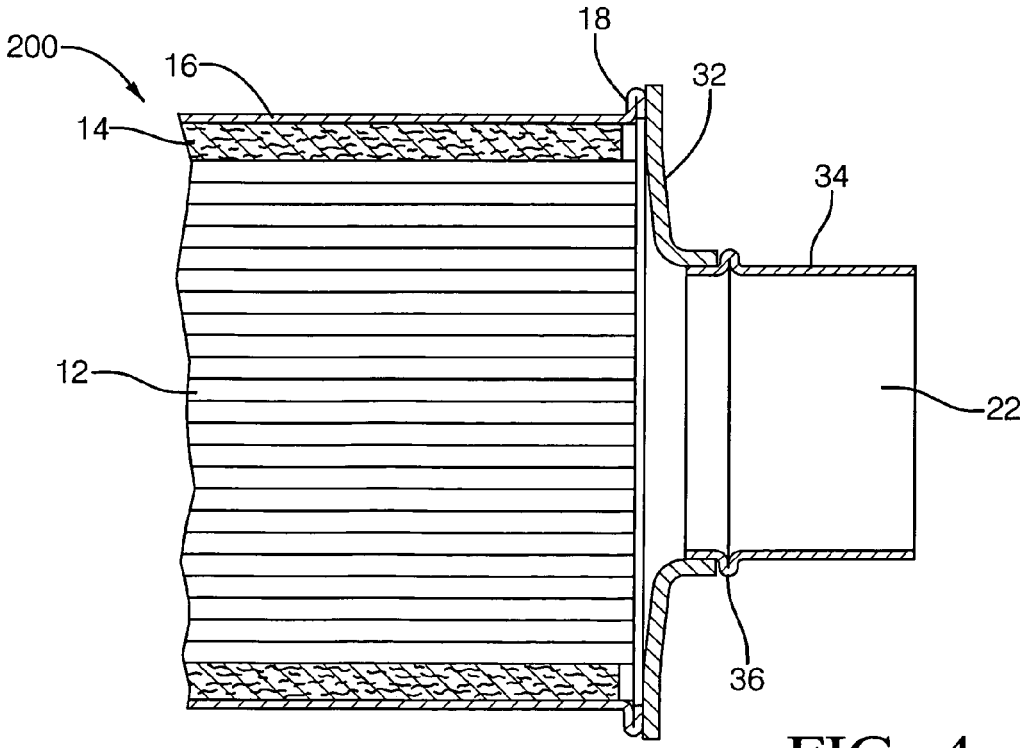
FIG. 4 is a partial cross-sectional view of an embodiment comprising an endplate.

FIG. 4 illustrates a catalytic converter embodiment generally designated 200 comprising an end plate 32. End plate 32 is joined to shell 16 using the ADRW method at the interface of shell rib portion 18 and the portion of end plate 32 abutting shell rib portion 18. In this embodiment, the catalyst substrate 12 is spaced away from endplate 32 to ensure proper gas flow in and out of the catalyst. Further, an inner ring (not shown) may be used to act as inner end cone for mat protection. Alternatively, a mat protection surface (not shown) like mat protection surface 28 of FIG. 2 may be formed in the same operation that creates shell rib portion 18. This embodiment further illustrates that ADRW may be used even when there is a disparity in the thickness of materials being welded, e.g., end plate 32 is thicker than shell 18. If MIG welding is used instead of ADRW for this embodiment, a material sufficiently thick (e.g., greater than or equal to about 1.45 mm) is employed for shell 16. Converter designs produced using the ADRW method are capable of using shell materials having a thickness less than about 1.5 mm, and even a thickness of less than about 0.66 mm in some embodiments. In the case of these embodiments, it is envisioned that thinner material may be used for the shell 16 as stated. Therefore, a deformation and/or displacement of about 0.66 mm to about 1.5 mm would occur in that example equal to both the parent material and weld bond.

FIG. 4 further depicts an inlet tube 34 comprising an opening 22 and an inlet tube rib portion 36 having a surface area sufficient to provide a welding interface with end plate 32. This embodiment illustrates that ADRW may be used to weld tubes to cones. In this example, deformation will occur at the interface between end plate 32 and inlet tube rib portion 36.

Figure 5:
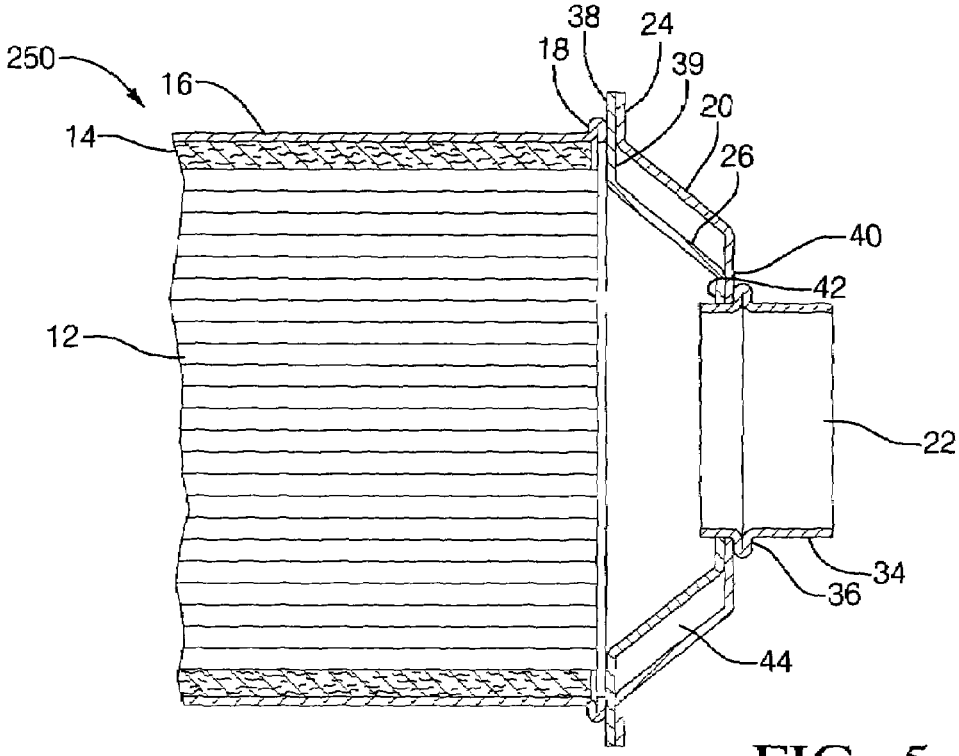
FIG. 5 is a partial cross-sectional view of an embodiment comprising a tube, and further depicting an insulating space between an inner and outer cone.

FIG. 5 illustrates a catalytic converter embodiment generally designated 250 comprising an insulating space 44. End cone 20 comprises a flange 24 and a tube-side weld area 40. Inner-end cone 26 comprises a flange 38 and a tube-side weld area 42. In this embodiment, flange 24 is welded to flange 38 of inner end cone 26 and flange 38 is welded to shell 16 at shell rib portion 18. Shell rib portion 18, end cone 20, and inner end cone 26 may be welded together at the same time. Similarly, an inlet tube 34 may be joined to end cone 20 and inner end cone 26 in the same fashion, i.e., by the ADRW method. In this example, tube-side weld area 40 of end cone 20, tube-side weld area 42 of inner end cone 26, and a rib portion 36 of inlet tube 34 are welded together. When inner end cone 26 is joined to shell 16 using ADRW, flange 38 having an extended length forms a mat protection surface 39. Furthermore, joining flange 24 and tube-side weld area 40 of end cone 20 to flange 38 and tube-side weld area 42 of inner end cone 26 respectively as described above, a sealed pocket is formed, which creates an insulating space 44. Since the materials being welded in these examples are full thickness, i.e., the materials have not been thinned due to extrusion, they may have more load bearing capacity compared to the thinned materials. Moreover, the sealed pocket advantageously allows the used of insulating materials that if otherwise left free to migrate could plug and/or contaminate the catalyst.

Examples of suitable insulating materials include formed ceramic fiber materials comprising vermiculite, refractory ceramic fibers, organic binders, combinations thereof, and the like. The insulating material may be a non-expanding ceramic material, an intumescent material, or a material comprising both. Examples of non-expanding ceramic fiber material includes, but is not limited to, ceramic materials such as those sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Examples of intumescent ceramic material include, but is not limited to, ceramic materials such as those sold under the trademark "INTERAM" by the "3M" Company, Minneapolis, Minn., as well as those intumescents which are also sold under the aforementioned "FIBERFRAX" trademark, as well as combinations thereof and others.

Figure 6:
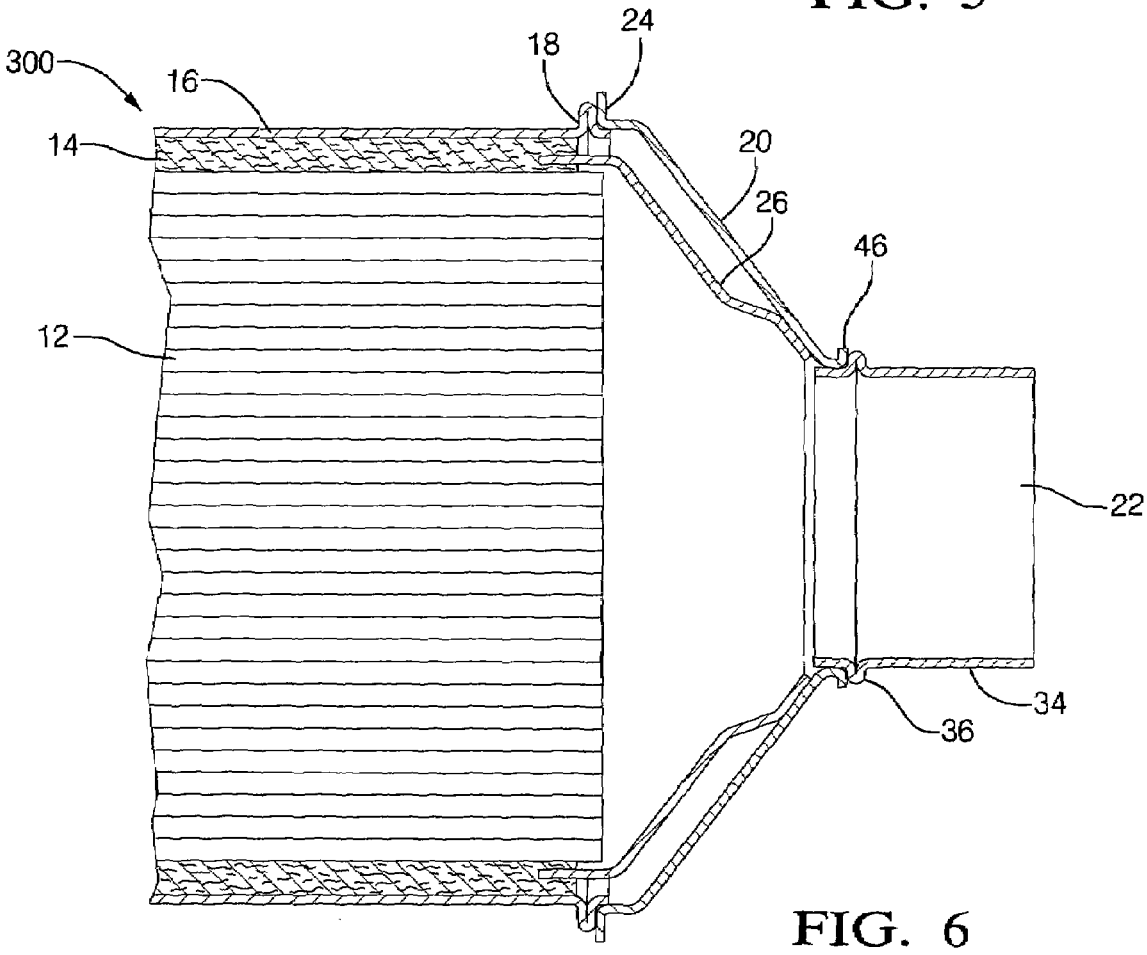
FIG. 6 is a partial cross-sectional view of an embodiment comprising a flared snorkel to tube weld interface illustrating the proposed ADRW joining method.

FIG. 6 illustrates a catalytic converter embodiment generally designated 300 comprising a flared snorkel to tube weld interface. In this embodiment, end cone 20 comprises a flared end portion 46. Flared end portion 46 abuts inlet tube rib portion 36. An electrode, as described above, may be used to join the interfaces being welded, i.e., flared end portion 46 and inlet tube rib portion 36. In this example, flared end portion 46 allows full thickness materials, i.e., materials that have not been thinned due to extrusion, to be joined. Accordingly, they may have a higher load bearing capacity compared to the thinned materials, which are more common in end cones where the snorkel extrusion end edge is the point where the adjoining tube is attached by MIG welding.

Figure 7:
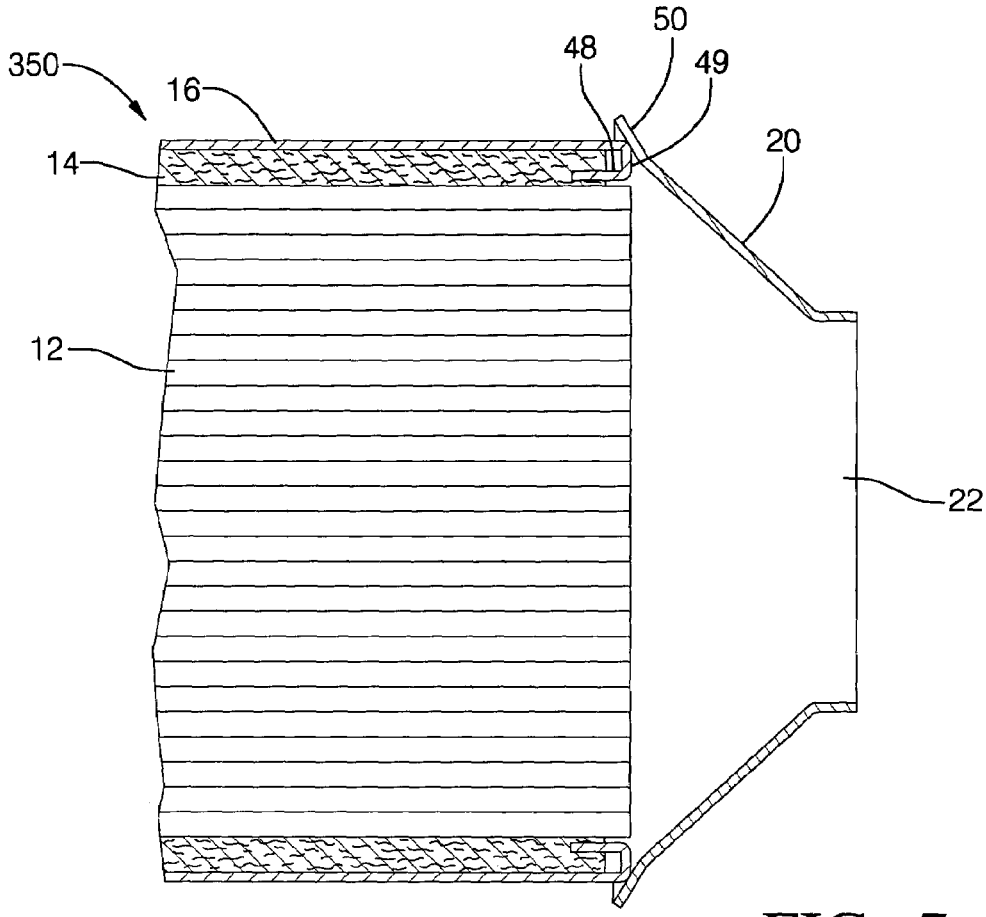
FIG. 7 is a partial cross-sectional view of an embodiment comprising a mat protection surface formed by a curled portion of the shell.

FIG. 7 illustrates a catalytic converter embodiment generally designated 350 comprising a mat protection surface 49 formed by a curled portion 48 of shell 16. Curled portion 48 protects the mat edge from, for example, erosion, allowing the elimination of the inner cone, which has this function as well as others. End cone 20 comprises an opening 22, and an angled welding interface 50, wherein the angled welding interface 50 has an angle of about 10 degrees to about 45 degrees relative shell 16 surface. Within this range, it is also desirable to have an angle of about 30 degrees to about 45 degrees. In this embodiment, the deformation detail is the angled welding interface 50. In using the ADRW method, curled portion 48 abuts angled welding interface 50. Deformation will occur at the interface between curled portion 48 and angled welding interface 50, which aids in impurity rejection as described above. Moreover, curled portion 48 has a sufficient stiffness, such that one electrode is sufficient, i.e., the welding may be completed without the use of a backup electrode.

Figure 8:
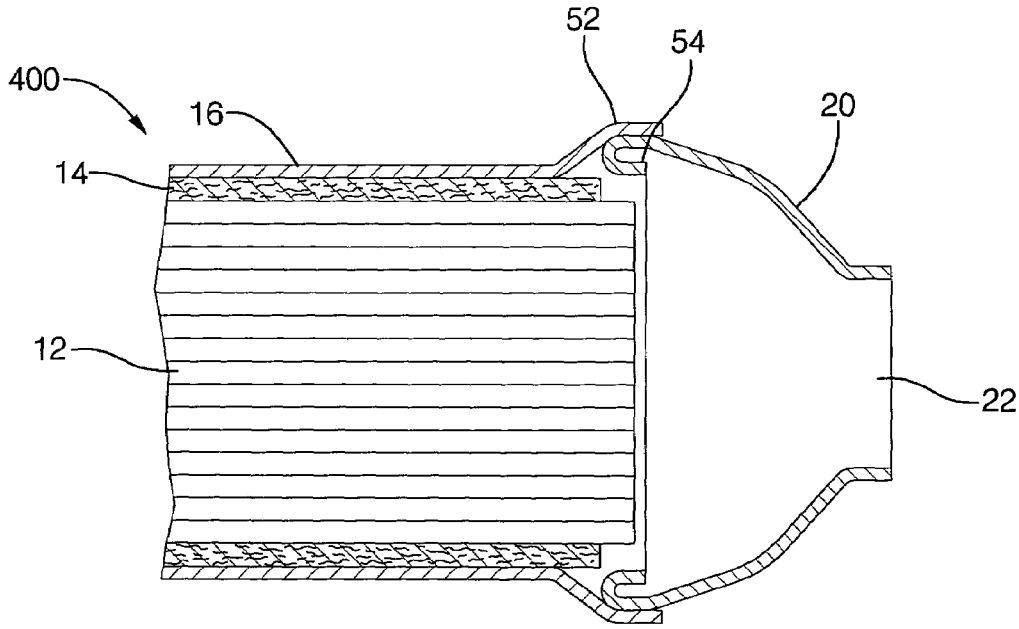
FIG. 8 is a partial cross-sectional view of an embodiment comprising a flared shell.

FIG. 8 illustrates a catalytic converter embodiment generally designated 400 comprising shell 16 having a flared end portion 52. An end cone 20 comprises an opening 22 and curved end portion 54. End cone 20 may be joined to shell 16 using the ADRW method. In other embodiments, end cone 20 may further comprise an inner end cone (not shown). End cone 20 may be slid inside the shell 16 at the end comprising flared end portion 52. In this embodiment, the deformation detail used in the ADRW method is the flared end portion 52. In the ADRW method, deformation will occur at the interface between end cone 20 and flared end portion 52. Advantageously, since end cone 20 is slid inside the flared area of shell 16, the overall package diameter may be reduced compared to designs where end cone 20 is lapped over shell 16.

Figure 9:
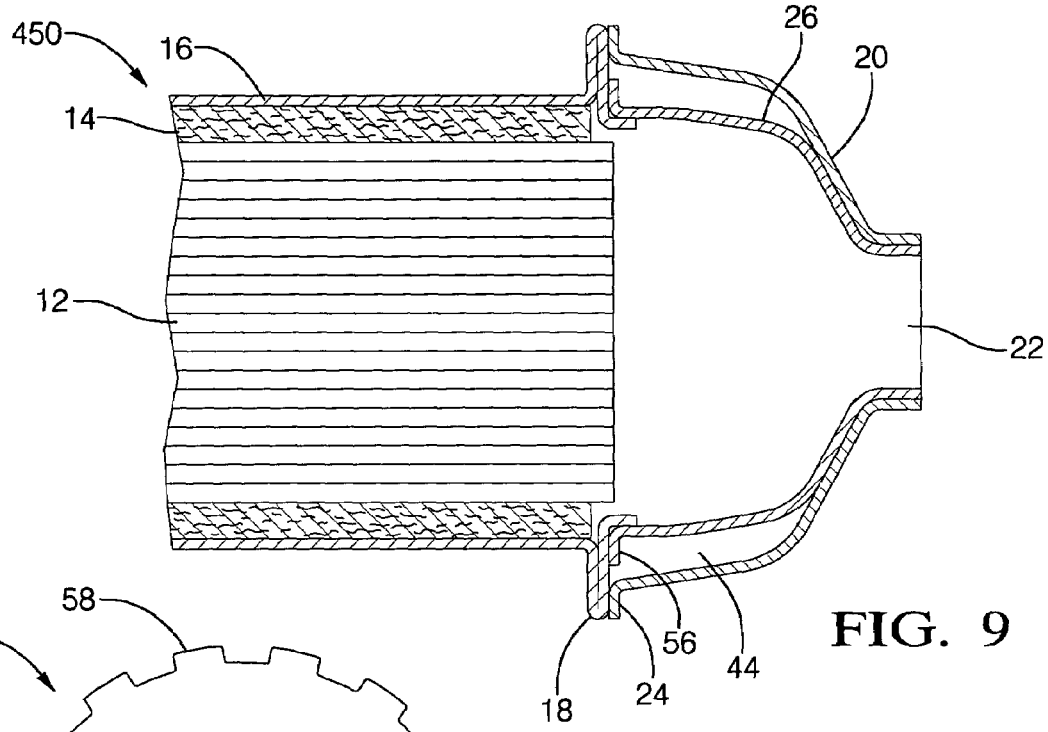
FIG. 9 is a partial cross-sectional view of an embodiment comprising an insulating space between an end cone and an inner cone, wherein the end cone is spot welded to the shell.

FIG. 9 illustrates a catalytic converter embodiment generally designated 450 comprising an insulating space 44 between end cone 20 and inner end cone 26. End cone 20 is spot welded at flange 24 at intervals that are sufficient to be robust against flexure due to low cycle fatigue caused by the mis-match in growth due to the temperature difference between inner cone 26 and end cone 20. However, the ADRW method is used to join shell 16 to inner end cone 26. Flange 56 of inner end cone 26 abuts shell rib portion 18. The ADRW method is used to join these layers together. Deformation occurs at the weld area, i.e., the interface between shell rib portion 18 and flange 56 of inner end cone 26. An insulating space 44 is created between end cone 20 and inner end cone 26 as described. Advantageously, insulating space 44 may be filled with an insulating material. Examples of suitable insulating materials included formed ceramic fiber materials comprising vermiculite, refractory ceramic fibers, organic binders, combinations thereof, and the like. The insulating material may be a non-expanding ceramic material, an intumescent material, or a material comprising both. Examples of non-expanding ceramic fiber material include, but is not limited to, ceramic materials such as those sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Examples of intumescent ceramic material includes, but is not limited to, ceramic materials such as those sold under the trademark "INTERAM" by the "3M" Company, Minneapolis, Minn., as well as those intumescents which are also sold under the aforementioned "FIBERFRAX" trademark, as well as combinations thereof and others.

Figure 10:
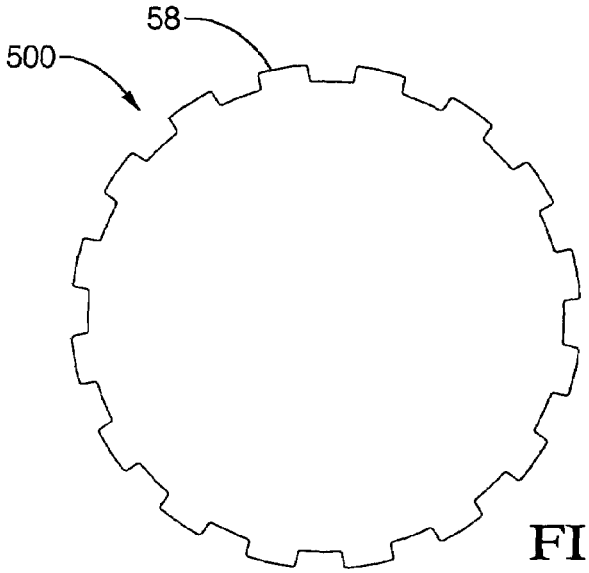
FIG. 10 is a cross-sectional view of an end portion of an end cone comprising tab portions.

Referring now to FIG. 10, a flange cross sectional area generally designated 500 is shown. In this exemplary embodiment, flange 500 comprises a plurality of tabs 58, which allow for mismatch in thermal expansion length due to temperature difference between an inner cone 26 and an end cone 20. An end cone comprising flange 500 having a plurality of tabs 58 may be applicable, for example, to end cone 20 of FIG. 9 where the inner cone 26 forms the gas sealing surface and endcone 20 encloses insulating area 44.

Figure 11:
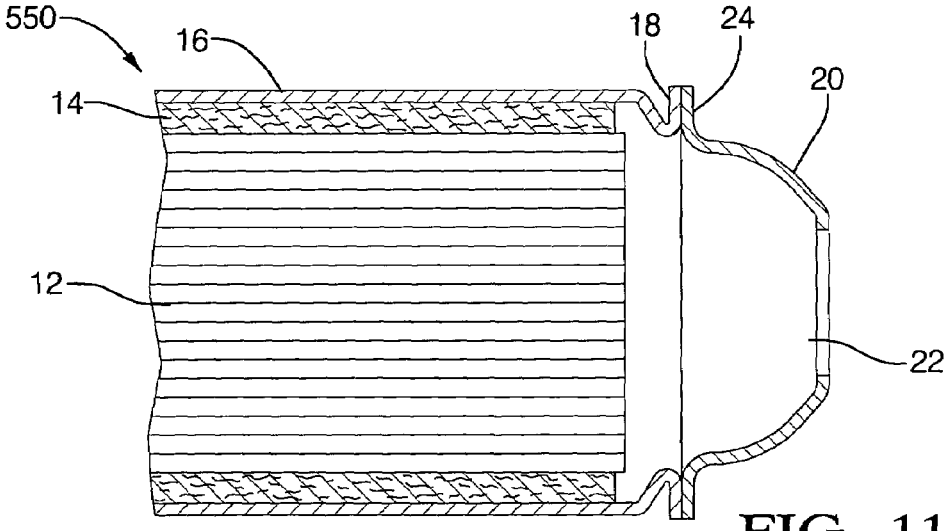
FIG. 11 is a partial cross-sectional view an embodiment comprising a concave rib portion at the weld interface.

FIG. 11 illustrates a catalytic converter embodiment generally designated 550. In this exemplary embodiment, shell 16 has ribbed portion 18 disposed inward compared to the exemplary embodiment depicted in FIG. 1 where ribbed portion 18 is disposed outwardly. In other words, ribbed portion 18 may be concave, as depicted in FIG. 11, or convex, as depicted in FIG. 1. Moreover, this exemplary embodiment has an overall package diameter less than that of the outwardly disposed ribbed portion. In joining end cone 20 to shell 16, ribbed portion 18 of shell 16 abuts flange 24 of end cone 20. Flange 24 comprises a mating surface sufficient for an electrode (not shown) to apply a pressure to create deformation during the ADRW method.

Figure 12:
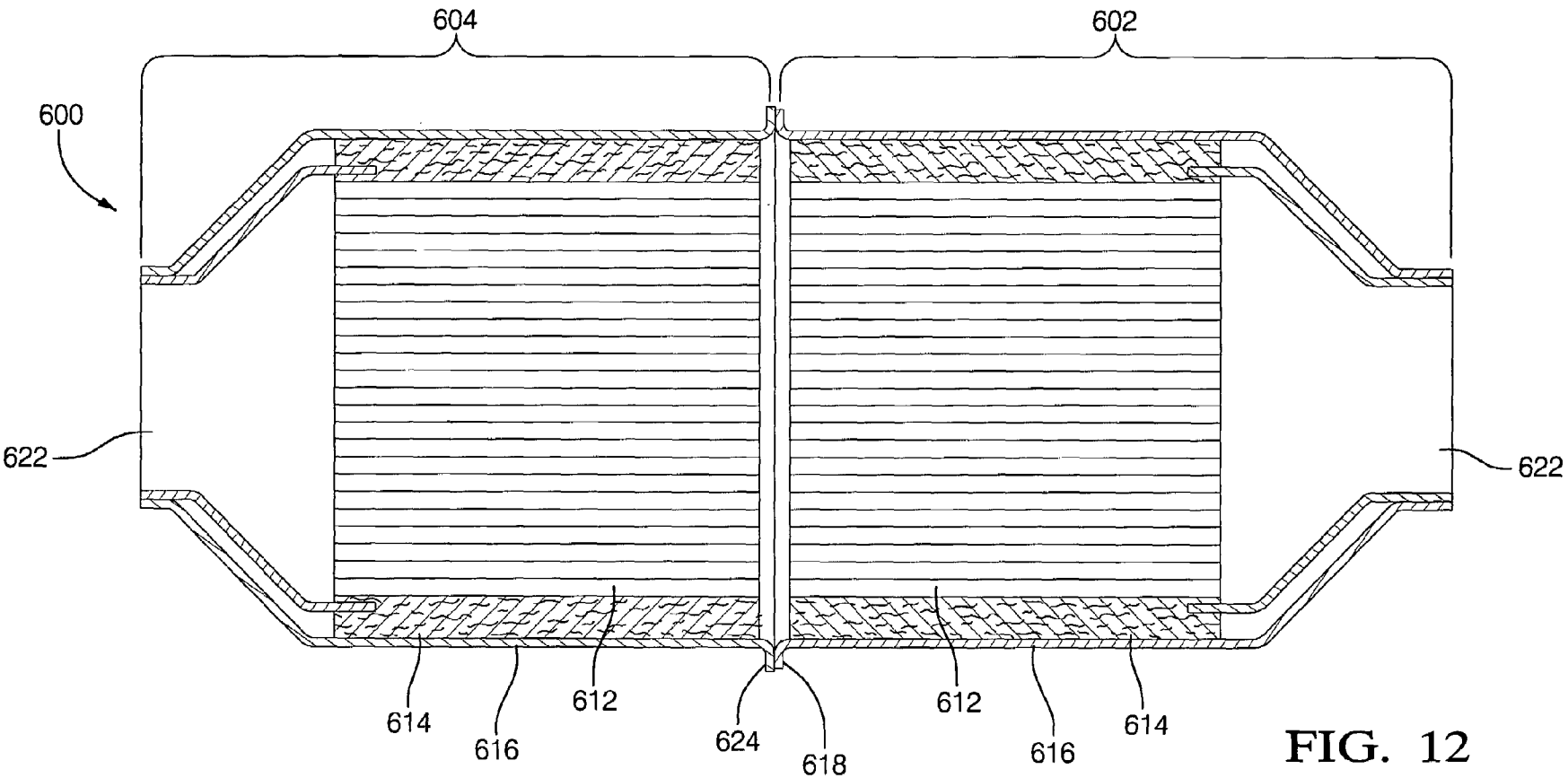
FIG. 12 is a partial cross-sectional view of an embodiment comprising two catalysts.

FIG. 12 illustrates an exemplary embodiment generally designated 600 comprising a first canned portion 602 and a second canned portion 604. First canned portion 602 comprises a catalyst substrate 612 inserted and housed within a shell 616 with a mat support material 614 disposed therebetween, and a rib portion 618 (i.e., deformation detail). Second canned portion 604 comprises a catalyst substrate 612 inserted and housed within a shell 616 with a mat support material 614 disposed therebetween, and flange 624. First canned portion 602 is joined to second canned portion 604 using the ADRW method. In joining first canned portion 602 to second canned portion 604, ribbed portion 618 of first canned portion abuts flange 624 of second canned portion 604. Flange 624 comprises a mating surface sufficient for an electrode (not shown) to apply a pressure to create deformation during the ADRW welding method. Moreover, this method allows for spinforming of snorkel ends or deep drawn shell halves. Shells 612 integrally transition into end cores forming concentric openings 622.

Further embodiments are envisioned, where the two part converter with central weldment may be used to create a converter that has inlet and outlet angles to the centerline of the part. First, a shell tube is cut at half the desired angle between snorkels. New tube ends are then formed to add features that facilitate the ADRW method (e.g., rib portion and/or flange). The tube sections are stuffed with catalyst in mat support and then joined together again after being rotated 180 degrees. This process produces a converter that has an angled body with the angle equal to about 2 times the original angle cut in the tube. This embodiment may be useful for close packaging in under hood and/or underbody areas. Embodiments are also envisioned where greater than two catalysts are canned separately and joined together using the ADRW method. The advantage of this type of construction is that each catalyst is individually stuffed into each container, which may eliminate the potential for high mat density caused by face angles between adjoining catalysts leading to potential breakage of the catalyst.

The same type of weld interface used in the ADRW method to form converter to tube joints, cone to shell joints, and the like may also be used for tube to tube joins. For example, in tube-to-tube joints, a first tube comprises a rib portion and second tube comprises a flange.

Catalyst substrate 12 comprises any ceramic material or "high temperature material" capable of operating under exhaust system conditions, i.e., temperatures up to about 1,100° C. and exposure to hydrocarbons, nitrous oxides, carbon monoxide, carbon dioxide, and/or sulfur in, for example, a spark ignition or diesel engine environment. These high temperature materials may be ceramic, metallic foils, combinations thereof, and other materials, that are capable of supporting the desired catalyst coating. Some possible ceramic materials include cordierite, silicon carbide, and the like, and mixtures thereof. One such material, "Cordierite", is commercially available from Coming, Inc., Corning, N.Y.

Catalyst substrate 12 may have any geometry, which provides a sufficient surface area for the catalyst, with a honeycomb structure being desirable. The honeycomb structure may have cells shaped like triangles, squares, rectangles, hexagons, octagons, diamonds and the like. In consideration of the tooling costs for extrusion molding or the like, however, the cells are generally square in shape. Moreover, it is desirable that catalyst substrate 12 has the greatest number of cells that is structurally feasible such that the inner surface area of catalyst substrate 12 is maximized. The surface area of the substrate should also be sufficient to support a sufficient amount of catalyst(s) to effectively catalyze exhaust fluid streams flowing therethrough, with the surface area being a function of the surface design of fluid passages, the volume of the substrate, and the effective density of the substrate. These parameters may be adjusted according to design specifications, taking into account both the desired shape of the catalytic converter and optimal paths for exhaust fluid flow. Additionally, it is desirable that catalyst substrate 12 is formed in geometric shapes such that mat support material 14 may be wrap around substrate 12 properly without delaminating or cracking, which may occur when bending the material around sharp radii, e.g., radii less than about 25 mm.

Catalyst substrate 12 may comprise any catalyst material sufficient to convert exhaust fluids to acceptable emission levels. Catalyst substrate 12 may be wash coated and/or imbibed with a catalyst, which may comprise a high surface area material, having one or more possible catalyst materials including noble metals such as platinum, palladium, rhodium, iridium, osmium and ruthenium; and other metals such as tantalum, zirconium, yttrium, cerium, nickel, and copper; and mixtures and alloys thereof, and other conventional catalysts.

The mat support 14 may comprise a material that enhances the structural integrity of the substrate by applying compressive radial forces about it, reducing its axial movement, and retaining it in place, is concentrically disposed around the substrate. Mat support material 14 may be a formed ceramic fiber material comprising vermiculite, refractory ceramic fibers, organic binders, combinations thereof, and the like. Mat support material 14 may be a non-expanding ceramic material, an intumescent material, or a material comprising both. Examples of non-expanding ceramic fiber material includes, but is not limited to, ceramic materials such as those sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Examples of intumescent ceramic material include, but is not limited to, ceramic materials such as those sold under the trademark "INTERAM" by the "3M" Company, Minneapolis, Minn., as well as those intumescents which are also sold under the aforementioned "FIBERFRAX" trademark, as well as combinations thereof and others.

The thickness of mat support material 14 may depend upon the temperature of the exhaust fluid, as well as the application of catalytic converter. For example, the thickness of mat support material used in catalytic converter for a spark ignition environment may differ from that used in a diesel environment. Moreover, as the exhaust fluid temperature range increases, the thickness of mat material 14 may also increase accordingly to meet customer skin temperature requirements. Generally, the mat support material thickness is about 2 mm to about 12 mm for most automotive applications, within this range it is also desirable to have a thickness of about 4 mm to about 8 mm.

The choice of material for the shell 16 depends upon the type of exhaust fluid, the maximum temperature reached by the catalyst substrate, the maximum temperature of the exhaust fluid stream, and the like. Suitable materials for the shell 16 may comprise any material that is capable of resisting under-car salt, temperature and corrosion. For example, ferrous materials may be employed such as ferritic stainless steels. Ferritic stainless steels may include stainless steels such as, e.g., the 400-Series such as SS-409, SS-439, and SS-441, with SS-409 particularly desirable. Acceptable SS type stainless steel may include stainless steels such as those sold under the trademarks "Type S40900" by Armco, Inc., in Pittsburgh, Pa.

Possible materials for the end-cone 20 include any material capable of maintaining the desired structural integrity in an operating environment consistent with exhaust fluid treatment, e.g., temperatures up to about 1,000° C., exposure to exhaust fluids, and extreme weather conditions. Although numerous materials and alloys can be employed, ferrous materials and alloys are typically used. High temperature, corrosion resistant, stainless steel is desirable, with stainless steel 400 series, e.g., type 409 and the like, being more desirable.

Advantageously, the Annular Deformation Resistance Welding (ADRW) method reduces weld time compared to other welding methods, e.g., MIG welding. The cycle time for ADRW is about 1 second. Therefore, an increased cell capacity may be realized, while using approximately the same capital. The ADRW method allows the weld to be monitored to indicate quality of the finished product, which is advantageous in that it may reduce weld repair, and may have potential for reducing capital expenditure for inspection equipment (e.g., elimination of leak tester). Further, welds made to end cones may have a greater load bearing capacity compared to welds using other methods, because full thickness materials are being joined, i.e., materials that have not been thinned by, for example, extrusion.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A catalytic converter comprising:

a generally cylindrical shell defining a characteristic line of elongation, said shell having at least one open end concentrically disposed on said line of elongation and an integrally formed welding deformation detail disposed adjacent said opening, said welding deformation detail including an axially displaceable radially distended circumferential rib portion defining a first circumferential welding surface;

a catalyst substrate inserted and housed within said shell;

mat support material disposed between said catalyst substrate and said shell;

an end cone concentrically aligned with the opening of said shell, said end cone forming a generally radially extending circumferential portion defining a second welding surface configured to matingly abut and axially displace said first welding surface of said rib portion; and a single circumferentially continuous deformation weldment interconnecting said end cone portion with the distended rib portion of said welding deformation detail; and an inlet tube comprising a radially outwardly extending circumferential rib portion, wherein an axial opening within said end cone is abutted and joined to said rib portion of said inlet tube by a second single continuous deformation weldment.

2. The catalytic converter of claim 1, wherein said welding deformation detail is a concave rib portion.

3. The catalytic converter of claim 1, wherein said welding deformation detail is a convex rib portion.

4. The catalytic converter of claim 1, wherein a mat protection surface is formed by said flange of said end cone.

5. The catalytic converter of claim 1, wherein a mat protection surface is formed by said rib portion of said shell.

6. The catalytic converter of claim 1, further comprising an inner end cone.

7. The catalytic converter of claim 1, further comprising an inner end cone comprising an inner end cone flange abutted and joined to said rib portion, wherein an insulating space is created between said end cone and said inner end cone.

8. The catalytic converter of claim 7, wherein said end cone flange comprises a plurality of tabs.

9. The catalytic converter of claim 7, wherein said insulating space is filled with a non-expanding ceramic material, an intumescent material, or a combination of the forgoing materials.

10. A catalytic converter comprising:

a generally cylindrical shell defining a characteristic line of elongation, said shell having at least one open end concentrically disposed on said line of elongation and an integrally formed welding deformation detail disposed adjacent said opening, said welding deformation detail including an axially displaceable radially distended circumferential rib portion defining a first circumferential welding surface;

a catalyst substrate inserted and housed within said shell;

mat support material disposed between said catalyst substrate and said shell;

an end plate concentrically aligned with the opening of said shell, said end plate forming a generally radially extending circumferential portion defining a second welding surface configured to matingly abut and axially displace said first welding surface of said rib portion; and a single circumferentially continuous deformation weldment interconnecting said end plate portion with the distended rib portion of said welding deformation detail; and an inlet tube comprising a radially outwardly extending circumferential rib portion, wherein an axial opening within said end plate is abutted and joined to said rib portion of said inlet tube by a second single continuous deformation weldment.

* * * * *